US006848409B2

(12) United States Patent
Kudo et al.

(10) Patent No.: US 6,848,409 B2
(45) Date of Patent: Feb. 1, 2005

(54) INTAKE SYSTEM FOR AN INTERNAL COMBUSTION ENGINE

(75) Inventors: Yuji Kudo, Kanagawa (JP); Masahiro Murata, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/855,339

(22) Filed: May 28, 2004

(65) Prior Publication Data

US 2004/0237925 A1 Dec. 2, 2004

(30) Foreign Application Priority Data

May 29, 2003 (JP) ..... 2003-151816
Apr. 14, 2004 (JP) ..... 2004-118489

(51) Int. Cl.[7] ..... F02M 35/10

(52) U.S. Cl. ..... 123/184.38; 123/184.61; 123/198 E

(58) Field of Search ..... 123/184.38–184.45, 123/184.61, 198 E

(56) References Cited

FOREIGN PATENT DOCUMENTS

JP 11-294280 A 10/1999

*Primary Examiner*—Noah P. Kamen
(74) *Attorney, Agent, or Firm*—Foley & Lardner LLP

(57) ABSTRACT

An intake system for an internal combustion engine includes an intake manifold adapted to be attached to a side wall of the engine, and an air cleaner for supplying intake air to the intake manifold. The air cleaner is disposed opposite to the side wall of the engine while interposing therebetween the intake manifold. The air cleaner has an air cleaner main body joined with the intake manifold to constitute a single unit. The air cleaner main body is made of a material lower in the strength than a material which the intake manifold is made of.

20 Claims, 3 Drawing Sheets

INTAKE SYSTEM FOR AN INTERNAL COMBUSTION ENGINE

BACKGROUND OF THE INVENTION

The present invention relates to an intake system for an internal combustion engine of a motor vehicle.

In a conventional engine layout, an intake manifold is arranged, in many cases, laterally of an engine. For this reason, a clearance or space between the intake manifold and its adjacent vehicle components is small as disclosed in Unexamined Japanese Patent Publication No. 11-294280.

SUMMARY OF THE INVENTION

When the clearance between the intake manifold and its adjacent vehicle components is small, there is a possibility that upon collision of a vehicle the intake manifold is broken while compressing fuel system components, leading to damage or breakage of the fuel system components.

It is accordingly an object of the present invention to provide an intake system for an internal combustion engine which is free from the above-noted problem inherent in the prior art system.

To achieve the above object, the present invention provides an intake system for an internal combustion engine comprising an intake manifold adapted to be attached to a side wall of the engine, and an air cleaner for supplying intake air to the intake manifold, the air cleaner being disposed opposite to the side wall of the engine while interposing therebetween the intake manifold, the air cleaner having an air cleaner main body joined with the intake manifold to constitute a single unit, the air cleaner main body being made of a material lower in the strength than a material which the intake manifold is made of.

DESCRIPTION OF THE PREFERRED EMBODIMENT

Figure 1:
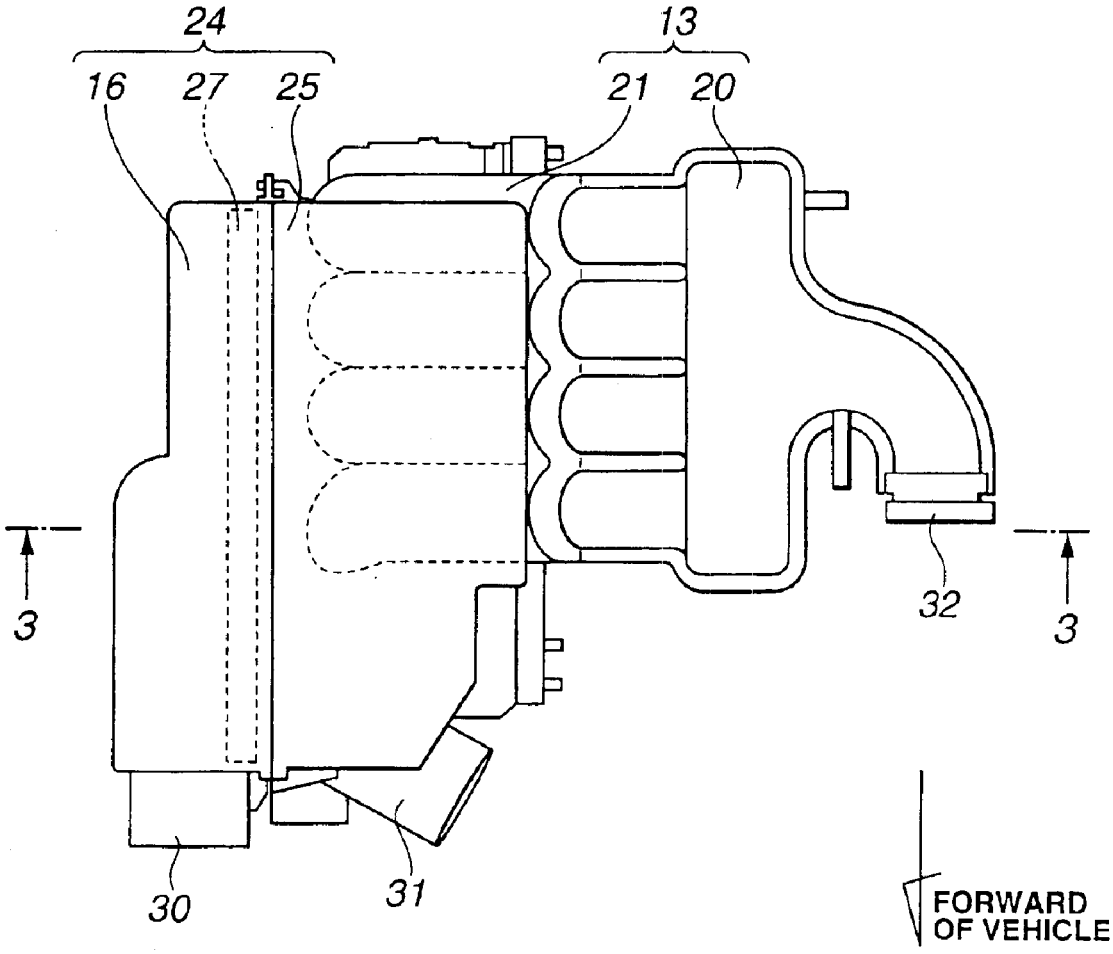
FIG. 1 is a plan view of an intake system of an internal combustion engine of a motor vehicle according to an embodiment of the present invention.
Figure 2:
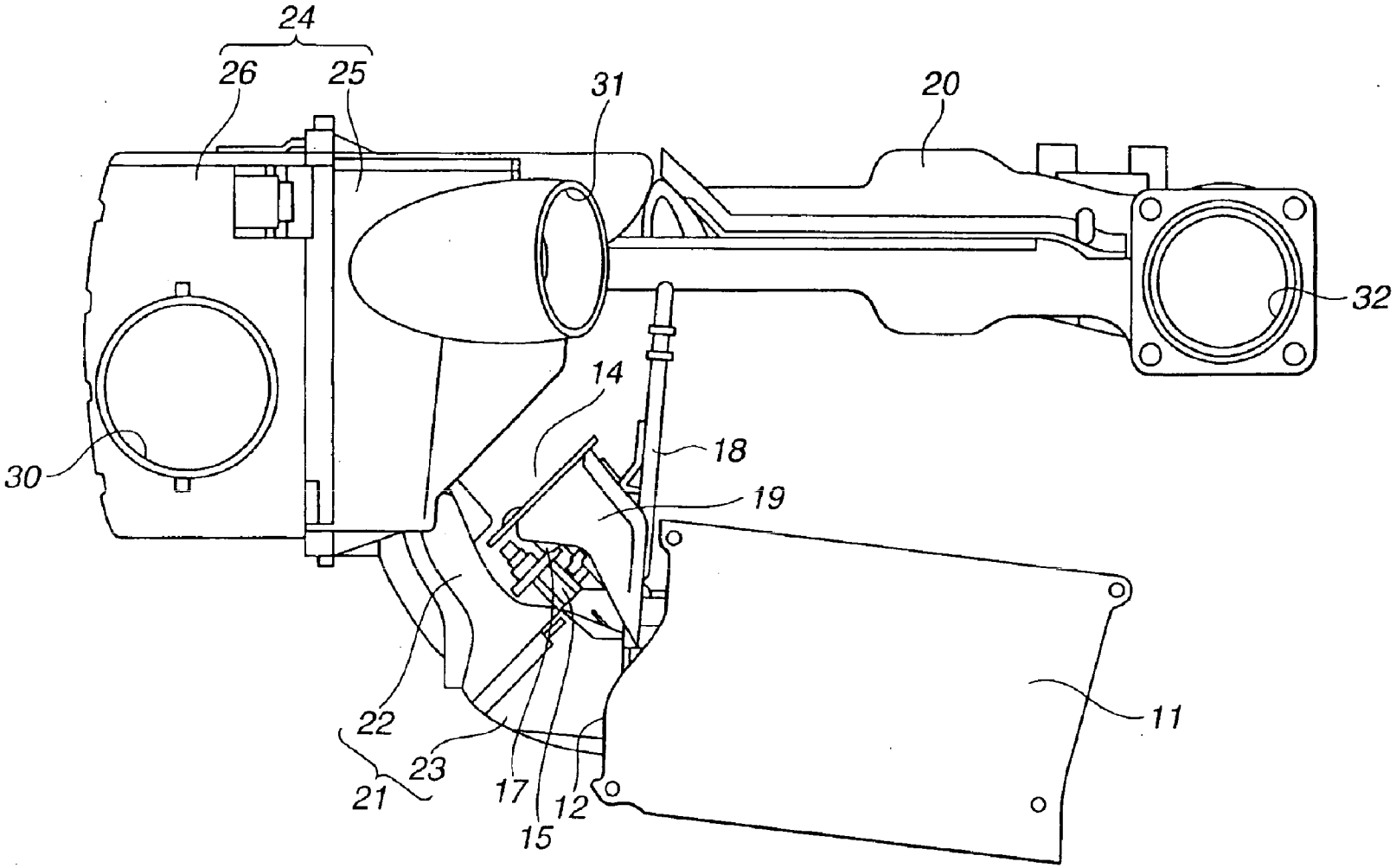
FIG. 2 is an elevational view of the intake system of FIG. 1 when observed from a front end side of the vehicle.
Figure 3:
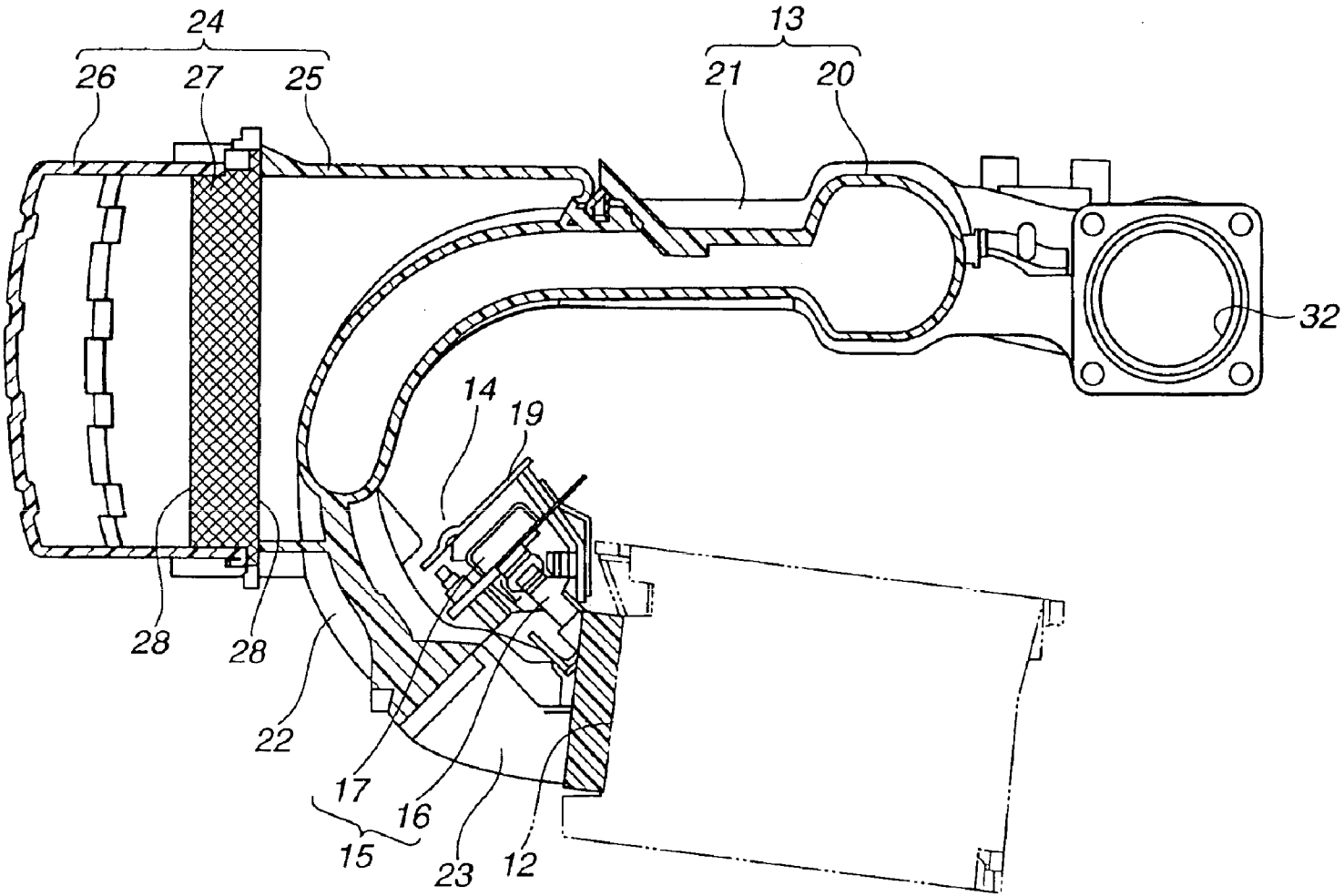
FIG. 3 is a sectional view taken along the line 3—3 of FIG. 1.

Referring to FIGS. 1 to 3, inclusive, cylinder head 11 made of metal such as aluminum alloy constitutes an engine main body together with a cylinder block (not shown). In the meantime, the engine in this embodiment is an in-line four-cylinder engine and installed on a vehicle so that a row of cylinders extends so as to coincide or in parallel with the longitudinal direction of the vehicle.

To one flat side wall 12 of cylinder head 11, i.e., the engine main body is connected intake manifold 13 made of resin.

In space 14 between intake manifold 13 and one side wall 12 of the engine main body is disposed fuel injection device 15 that are made up of fuel system components. Namely, fuel injection device 15 includes fuel injectors 16 provided to the respective cylinders and fuel tube 17 elongated along the row of cylinders so as to conduct fuel to fuel injectors 16. Fuel is supplied to fuel tube 17 from a fuel tank (not shown) by way of fuel pipe 18. Further disposed in space 14 is protector 19 that surrounds fuel injection device 15 for protecting the same.

Intake manifold 13 includes collector portion 20 located above cylinder head 11 and branch portion 21 with four branch pipe sections (no numeral). The branch pipe sections are joined together and adapted to form intake passages corresponding in number to the engine cylinders. Branch portion 21 is disposed downstream of collector portion 20 with respect to the direction of flow of intake air and generally U-shaped so as to curve from one side wall 12 toward the upper side of cylinder head 11.

Branch portion 21 includes upper branch section 22 and lower branch section 23 that are joined together by vibration welding. Upper branch section 22 is joined with air cleaner 24.

Air cleaner 24 is disposed opposite to one side wall 12 of cylinder head while interposing therebetween intake manifold 13. Air cleaner 24 is joined with intake manifold 13 to constitute a single unit.

More specifically, air cleaner 24 includes casing base 25 elongated along the row of cylinders and formed integral with upper branch section 22, cleaner cover 26 adapted to serve as an air cleaner main body and cleaner element 27 disposed within a chamber defined by casing base 25 and cleaner cover 26.

Cleaner cover 26 is detachably attached to casing base 25 formed integral with upper branch section 22 and located closer to one lateral end of the vehicle than branch portion 21, i.e., located more leftward in FIGS. 1 to 3. Cleaner cover 26 is elongated along the row of cylinders so as to cover branch portion 21 entirely. Cleaner cover 26 is made of a material lower in the strength than the material which intake manifold 3 is made of. Specifically, cleaner cover 26 is made of a material lower in the material strength that is determined based on a tension strength (Young's modulus) and a heat-resistant temperature. In this embodiment, intake manifold 13 is made of PA6-GF30 (GF-reinforced PA6 containing 30 wt % of grass fiber), whereas cleaner cover 26 is made of PP (polypropylene).

Cleaner element 27 is elongated throughout the length of air cleaner 24 extending along the row of engine cylinders. Specifically, cleaner element 27 is in the form of a flat plate and extended nearly in parallel with one side wall 12 of cylinder head 11 which is connected with branch portion 21 of intake manifold 13. More specifically, cleaner element 27 has filter surfaces 28 which respectively define a treated area and an untreated area, i.e., which are opposed in the direction of flow of intake air and extended nearly in parallel with one side wall 12 of, cylinder head 11, i.e., perpendicularly to the widthwise direction of the vehicle.

Brief description being made to the flow of intake air to be supplied to the engine, intake air is introduced into air cleaner 24 through cleaner inlet port 30. After filtered by cleaner element 27, intake air is supplied through cleaner outlet port 31' provided to casing base 25 and a duct (not shown) to intake manifold inlet port 32 provided to collector portion 20. Thereafter, the intake air is drawn through collector portion 20 of intake manifold 13 and branch portion 21 to combustion chambers of the respective cylinders.

In the meantime, cleaner inlet port 30 provided to cleaner cover 26 is circular in section and has a center axis parallel with the longitudinal direction of the vehicle, i.e., parallel with filter surfaces 28 of cleaner element 27. Namely, cleaner inlet port 30 provided cleaner cover 26 is formed so that intake air is drawn rearward of the vehicle into air cleaner 24, i.e., in parallel with filter surfaces 28 of cleaner element 27. While it is generally desirable to dispose cleaner inlet port 30 so that the center axis of cleaner inlet port 30 is perpendicular to filter surfaces 28 of cleaner element 27 with consideration of a filtration efficiency of cleaner element 27, the center axis of cleaner inlet port 30 is disposed so as to be parallel with filter surfaces 28 thereby retaining a suitable rigidity against an input force in the lateral direction of the vehicle. Further, the circular shape of cleaner inlet port 30 is desirable from the point of view of retaining a suitable rigidity against an input force in the lateral direction of the vehicle.

By disposing cleaner cover 26 opposite to one side wall 12 of cylinder head 11 while interposing therebetween intake manifold 13 and by joining cleaner cover 26 with intake manifold 13 so as to constitute a single unit, cleaner cover 26 can serve as a buffer member that absorbs and mitigates an impact force upon lateral collision or forwardly oblique collision on the intake manifold 13 side, i.e., upon collision in which an impact is applied to a lateral end of the vehicle on the intake manifold 13 side since cleaner cover 26 breaks earlier than branch portion 21 of intake manifold 13, thus making it possible to prevent intake manifold 13 from being broken in case of light collision. Namely, by air cleaner 24 that breaks earlier than intake manifold 13 thereby absorbing the impact force upon collision, the impact energy acting upon intake manifold 13 can be reduced.

Further, since cleaner element 27 is disposed so as to extend nearly in parallel with one side wall 12 of cylinder head 11 that is connected with branch portion 21 of intake manifold 13, i.e., cleaner element 27 is extended along a plane to which the widthwise direction of the vehicle is perpendicular, it does not resist too strongly against an input force upon lateral collision or forwardly oblique collision but is broken easily. Thus, cleaner element 27 can serve as a buffer member and further reduce the impact energy acting upon intake manifold 13.

Since cleaner cover 26 is joined with entire branch portion 21 along the row of cylinders so as to constitute a single unit, intake manifold 13 is entirely covered by cleaner cover 26, thus making it possible to reduce the impact energy acting upon intake manifold 13 upon lateral collision or forwardly oblique collision on the intake manifold 13 side efficiently.

Further, since absorption of the impact energy by air cleaner 24 makes it possible to prevent or suppress deformation or breakage of intake manifold 13 upon collision, it becomes possible to prevent fuel injection device 15 interposed between intake manifold 13 and one side wall 12 of cylinder head 11 from being disabled to inject fuel due to deformation caused by the interference with intake manifold 13.

The technical concept obtained from the above described embodiment will be described together with the effect.

(1) An intake system of an internal combustion engine adapted to draw intake air into cylinders by way of an air cleaner and an intake manifold, wherein an air cleaner main body is joined with the intake manifold so as to constitute a single unit and disposed opposite to one side wall of an engine main body that is connected with the intake manifold while interposing the intake manifold between the one side wall of the engine main body and the air cleaner, and the air cleaner main body is made of a material lower in the strength than a material which the intake manifold is made of. By this, upon lateral collision or forwardly oblique collision on the intake manifold side, the air cleaner main body is broken earlier than the intake manifold, thus making it possible to absorb and mitigate the impact force actually applied to the intake manifold.

(2) In an intake system for an internal combustion engine according to the above-described technical concept (1), the intake manifold includes a branch portion having a plurality of intake passages corresponding in number to cylinders, and the air cleaner main body is elongated along the row of cylinders so as to cover the branch portion entirely. By this, the impact energy applied to the intake manifold can be effectively reduced by breakage of the air cleaner.

(3) In an intake system for an internal combustion engine according to the above described technical concept (1) or (2), a cleaner element disposed inside the air cleaner main body is disposed so as to extend nearly in parallel with the one side wall of the engine. By this, the element is adapted serve as a buffer member, thus making it possible to further reduce the impact force actually applied to the intake manifold upon collision.

The entire contents of Japanese Patent

Applications P2003-151816 (filed May 29, 2003) and P2004-1184B9 (filed Apr. 14, 2004) are incorporated herein by reference.

Although the invention has been described above by reference to a certain embodiment of the invention, the invention is not limited to the embodiment described above. Modifications and variations of the embodiment described above will occur to those skilled in the art, in light of the above teachings.

What is claimed is:

1. An intake system for an internal combustion engine comprising:

an intake manifold adapted to be attached to a side wall of the engine; and an air cleaner for supplying intake air to the intake manifold;

the air cleaner being disposed opposite to the side wall of the engine while interposing therebetween the intake manifold;

the air cleaner having an air cleaner main body joined with the intake manifold to constitute a single unit, the air cleaner main body being made of a material lower in the strength than a material which the intake manifold is made of.

2. An intake system according to claim 1, wherein the intake manifold comprises a branch portion having a plurality of intake passages corresponding in number to cylinders of the engine, and the air cleaner main body is elongated along a row of cylinders so as to cover the branch portion.

3. An intake system according to claim 1, wherein the air cleaner comprises a cleaner element extended nearly in parallel with the side wall of the engine.

4. An intake system according to claim 3, wherein the air cleaner further comprises a casing base formed integral with the intake manifold and a cleaner cover detachably attached to the casing base, the air cleaner main body being constituted by the cleaner cover.

5. An intake system according to claim 4, wherein the intake manifold comprises a collector portion and a branch portion, the casing base being formed integral with the branch portion.

6. An intake system according to claim 1, wherein the air cleaner comprises a circular inlet port having a center axis nearly in parallel with the side wall of the engine.

7. An intake system according to claim 1, wherein the intake manifold is made of GF-reinforced PA6 and the air cleaner main body is made of polypropylene.

8. An intake system for an internal combustion engine comprising:

an engine main body having a flat side wall;

an intake manifold attached to the side wall of the engine main body; and an air cleaner for supplying intake air to the intake manifold;

the air cleaner being disposed opposite to the side wall of the engine main body while interposing therebetween the intake manifold;

the air cleaner having an air cleaner main body joined with the intake manifold to constitute a single unit, the air cleaner main body being made of a material lower in the strength than a material which the intake manifold is made of.

9. An intake system according to claim 8, wherein the intake manifold comprises a branch portion having a plurality of intake passages corresponding in number to cylinders of the engine, and the air cleaner main body is elongated along a row of the cylinders so as to cover the branch portion.

10. An intake system according to claim 8, wherein the air cleaner comprises a cleaner element in the form of a flat plate, the cleaner element being extended nearly in parallel with the side wall of the engine main body.

11. An intake system according to claim 8, wherein the air cleaner comprises a circular inlet port having a center axis nearly in parallel with the side wall of the engine.

12. An intake system according to claim 8, wherein the air cleaner further comprises a casing base formed integral with the intake manifold and a cleaner cover detachably attached to the casing base, the air cleaner main body being constituted by the cleaner cover.

13. An intake system according to claim 8, wherein the intake manifold is made of GF-reinforced PA6 and the air cleaner main body is made of polypropylene.

14. In a motor vehicle, an intake system for an internal combustion engine comprising:

an engine main body having a flat side wall to which a widthwise direction of a vehicle body is nearly perpendicular;

an intake manifold attached to the side wall of the engine main body; and an air cleaner for supplying intake air to the intake manifold;

the air cleaner being disposed opposite to the side wall of the engine while interposing therebetween the intake manifold;

the air cleaner having an air cleaner main body joined with the intake manifold to constitute a single unit, the air cleaner main body being made of a material lower in the strength than a material which the intake manifold is made of.

15. An intake system according to claim 14, wherein the intake manifold comprises a branch portion having a plurality of intake passages corresponding in number to cylinders of the engine, and the air cleaner main body is elongated along a row of the cylinders so as to cover the branch portion.

16. An intake system according to claim 14, wherein the air cleaner comprises a cleaner element in the form of a flat plate, the cleaner element being extended nearly in parallel with the side wall of the engine main body.

17. An intake system according to claim 16, wherein the air cleaner further comprises a casing base formed integral with the intake manifold and a cleaner cover detachably attached to the casing base, the air cleaner main body being constituted by the cleaner cover.

18. An intake system according to claim 17, wherein the intake manifold comprises a collector portion and a branch portion, the casing base being formed integral with the branch portion.

19. An intake system according to claim 14, wherein the air cleaner comprises a circular inlet port having a center axis extending nearly in parallel with a longitudinal direction of the vehicle.

20. An intake system according to claim 14, wherein the intake manifold is made of GF-reinforced PA6 and the air cleaner main body is made of polypropylene.

* * * * *